US006572803B1

(12) United States Patent
Coe et al.

(10) Patent No.: US 6,572,803 B1
(45) Date of Patent: Jun. 3, 2003

(54) LIQUID COLOR FEED SYSTEM FOR SYNTHETIC YARNS

(75) Inventors: Michael Scott Coe, Bristol, VA (US); Charles P. McCamy, Gastonia, NC (US); Humayun N. Shaikh, Lahore (PK)

(73) Assignee: Burke Mills, Inc., Valdese, NC (US)

( * ) Notice: Subject to any disclaimer, the term of this patent is extended or adjusted under 35 U.S.C. 154(b) by 99 days.

(21) Appl. No.: 09/666,196

(22) Filed: Sep. 21, 2000

Related U.S. Application Data

(60) Provisional application No. 60/154,992, filed on Sep. 21, 1999.

(51) Int. Cl.[7] ..... D01F 1/06
(52) U.S. Cl. ..... 264/78; 264/211
(58) Field of Search ..... 264/78, 211; 8/494

(56) References Cited

U.S. PATENT DOCUMENTS 5,062,713 A 11/1991 Farquharson et al.
5,516,476 A 5/1996 Haggard et al.
5,833,893 A 11/1998 Jones et al.
5,851,562 A 12/1998 Haggard et al.
6,110,405 A 8/2000 King et al.

FOREIGN PATENT DOCUMENTS

WO WO 99/14407 A1 3/1999

*Primary Examiner*—Leo B. Tentoni
(74) *Attorney, Agent, or Firm*—Adams, Schwartz & Evans, P.A.

(57) ABSTRACT

A method of infusing liquid dyestuff into synthetic yarns at the point of fiber production, comprising the steps of providing a molten polymer, at least one non-molten liquid dye, and a spin pack assembly adapted for receiving and mixing the molten polymer and the non-molten liquid dye therein to form a colored molten polymer composition. The spin pack assembly includes a screen for filtering the molten polymer therethrough, and a spinneret adapted for receiving and extruding the molten polymer composition therethrough to form a plurality of colored fibers adapted for being formed into the synthetic yarns. The method also includes the steps of metering the liquid dye and the molten polymer into the spin pack assembly upstream from the spinneret, mixing the liquid dye and the molten polymer together between the screen and the spinneret within the spin pack assembly, thereby forming said colored molten polymer composition; and extruding the polymer composition through the spinneret, thereby forming the colored fibers.

11 Claims, 6 Drawing Sheets

LIQUID COLOR FEED SYSTEM FOR SYNTHETIC YARNS

This application is based on Provisional Application No. 60/154,992, filed on Sep. 21, 1999.

TECHNICAL FIELD AND BACKGROUND OF THE INVENTION

This invention relates to an apparatus and process for infusing liquid dyestuff into synthetic yarn at the point of fiber production. The apparatus and process has application with any synthetic filament fiber, including but not limited to nylon, polyester and polypropylene. The process can be carried out on partially-oriented yarn ("POY") which is subsequently texturized by one of several known processes, on fully-oriented yarn, or on yarn which is left in its flat state.

Current technology for providing color to synthetic yarn is based on the principle of combining natural, white polymer feedstock together with dye to produce a colored material called "master batch." Master batch is initially produced in chip form, and is then melted and extruded into filaments. This process is described in the Haggard, et al., U.S. Pat. No. 5,516,476, ("'476 Patent"), which is incorporated herein by reference. Melting and extruding master batch chips has several significant disadvantages, including higher cost due to higher waste, increased time and costs associated with master batch production, and various adverse effects on downstream processes. Since the chip material is produced in batches, it is often difficult to achieve precise color matches from batch to batch. A color dryer is required, further adding to costs. Static electricity during the run can cause the master batch chips to stick together and not feed properly. Chip size is also very important, and any significant variation can cause streaks and other defects in the filament fibers ultimately produced. Furthermore, variations in the quality of the process control employed as a master batch undergoes color drying and extrusion often adversely affect the final product. For example, heat variations within the extruder can cause color streaks or shifts in a master batch. Unfortunately, the ability to make adjustments to the color during processing is very limited, because such adjustments can only be made from light to dark or from dark to light on the shade. Complete color changes require complete clearing of the entire extrusion line, which results in wasted material and may create 8 to 12 hours of downtime, which significantly delays the extrusion process.

The apparatus and process according to the present invention eliminates altogether the need to produce master batches of colored polymer. Because master batches are not used, the need for a master batch production line is completely eliminated. A side-arm extruder, master batch feed system and master batch dryer are no longer required, and the costs, inconveniences and inefficient use of time associated with master batch production are completely eliminated. Color repeatability is improved at reduced production and capital investment costs. Moreover, change from one color to another is very rapid, permitting quicker response to market demands for particular colors.

The novel apparatus and process of the present invention achieves these improvements by injecting non-molten liquid dye directly into the spin pack after the screens and immediately before the point at which extrusion of the molten polymer occurs through the spinnerette. Introducing the liquid dye into the spin pack assembly upstream from the spinneret further permits color to be added to the polymer without passing the dye through an extruder. Bypassing the extruder saves additional time and eliminates costs typically associated with the cleaning and maintenance involved in changing colors during conventional master batch production processes.

The liquid dye used in the present invention is less expensive than master batch chips. The color may be quickly adjusted during production runs, which reduces overall waste. Furthermore, the exact color may be repeated from one batch to another and within the same batch. Color may also be changed on each thread line, or on multiple thread lines by position, which further enhances production flexibility. Since the liquid dye is not passed through an extruder prior to entering the spinneret, streaks in the final product are eliminated that would have otherwise been created due not only to chip size variation, but also to exposure of the dye to heat and oxidation within the extruder. Polymer strength is also improved, as are light fastness and weathering characteristics.

Using the apparatus and process of the present invention results in increased customer satisfaction. Eliminating the use of master batches reduces the time required for shade match approval by two to six weeks, reduces production lead times, permits small lot production quantities to be offered, and allows specific shades to be reproduced on re-orders. Such competitive advantages, along with the improvements in the coloring process described above, are unique to the present invention, and have thus far not been achieved using conventional master batch techniques.

SUMMARY OF THE INVENTION

Therefore, it is an object of the invention to provide an apparatus and process for dyeing polymer material during the filament extrusion process.

It is another object of the invention to provide an apparatus and process for dyeing polymer material during the filament extrusion process using a liquid dye.

It is another object of the invention to provide an apparatus and process for dyeing polymer material during the filament extrusion process using a liquid dye that does not have to be mixed with a molten carrier prior to being introduced to the molten polymer material from which the fiber filaments are formed.

It is another object of the invention to provide an apparatus and process for dyeing polymer material which does not require the use of a master batch, and eliminates all of the materials, equipment and costs associated with such use.

It is another object of the invention to provide an apparatus and process for dyeing polymer material which results in fiber filaments having one or more colors that can be accurately duplicated from one batch to another.

It is another object of the invention to provide an apparatus and process for dyeing polymer material which improves the strength, lightfastness, and weathering characteristics of the synthetic fiber filaments ultimately produced.

These and other objects of the present invention are achieved in the preferred embodiments disclosed below by providing a method for infusing liquid dyestuff into synthetic yarns at the point of fiber production, which includes the step of providing a molten polymer, at least one non-molten liquid dye, and a spin pack assembly adapted for receiving and mixing the molten polymer and the non-molten liquid dye therein to form a colored molten polymer composition. The spin pack assembly includes a screen for filtering the molten polymer therethrough, and a spinneret adapted for receiving and extruding the colored molten polymer composition therethrough to form a plurality of colored fibers adapted for being formed into the synthetic yarns. The liquid dye and the molten polymer are metered into the spin pack assembly and mixed together between the screen and the spinneret to form the colored molten polymer composition. The polymer composition is then extruded through the spinneret, thereby forming the colored fibers.

According to one preferred embodiment of the invention, a method of infusing liquid dyestuff into synthetic yarns at the point of fiber production is disclosed in which a molten polymer, a plurality of non-molten liquid dyes, and a spin pack assembly are provided. The spin pack assembly is adapted for receiving and mixing the molten polymer and the non-molten liquid dyes therein to form a colored molten polymer composition, and includes a screen for filtering the colored molten polymer composition therethrough and a spinneret adapted for receiving and extruding the molten polymer composition therethrough to form a plurality of colored fibers adapted for being formed into the synthetic yarns. The liquid dyes and the molten polymer are metered into the spin pack assembly; and mixed together between the screen and the spinnneret to form the colored molten polymer composition, which is then extruded through the spinneret, thereby forming the colored fibers.

According to another preferred embodiment of the invention, a method for infusing liquid dyestuff into synthetic yarns at the point of fiber production is disclosed which includes the step of providing a molten polymer, at least one non-molten liquid dye, and a spin pack assembly. The spin pack assembly includes a plurality of plates in fluid communication with one another and adapted for receiving and mixing the molten polymer and the non-molten liquid dye therein to form a colored molten polymer composition. The spin pack assembly also includes a spinneret positioned downstream from and in fluid communication with the plates for receiving and extruding the colored molten polymer composition into a plurality of colored fibers adapted for being formed into the synthetic yarns. The liquid dye and the molten polymer are metered into the plates and mixed together therein to form the colored molten polymer composition. The colored molten polymer composition is then extruded through the spinneret to form the colored fibers.

According to yet another preferred embodiment of the invention, a method for infusing liquid dyestuff into synthetic yarns at the point of fiber production is disclosed, including the step of providing a molten polymer, at least one non-molten liquid dye, and a spin pack assembly including a first mix plate positioned upstream from a second mix plate and a spinneret positioned downstream from the second mix plate. The first and second mix plates are in fluid communication with one another and are adapted for receiving and mixing the molten polymer and the non-molten liquid dye there between to form a colored molten polymer composition. The spinneret is positioned downstream from and is in fluid communication with the second mix plate for receiving and extruding the colored molten polymer composition therethrough to form a plurality of colored fibers adapted for being formed into the synthetic yarns. The liquid dye and the molten polymer are metered into the first mix plate and mixed together between the first and second mix plates to form the colored molten polymer composition. The colored molten polymer composition is then extruded through the spinneret to form the colored fibers.

According to yet another preferred embodiment of the invention, a method for infusing liquid dyestuff into synthetic yarns at the point of fiber production is disclosed and includes the step of providing a molten polymer and at least one non-molten liquid dye. A spin pack assembly is also provided and includes a first mix plate positioned upstream from a second mix plate. The first and second mix plates define a plurality of intersecting passageways extending there between. Each of the passageways is adapted for receiving and mixing the molten polymer and the non-molten liquid dye therein to form a colored molten polymer composition. The spin pack assembly also includes a spinneret positioned downstream from and in fluid communication with the passageways for receiving and extruding the colored molten polymer composition to form a plurality of colored fibers adapted for being formed into the synthetic yarns. The liquid dye and the colored molten polymer are metered into a respective one of the passageways and then mixed together within the passageways to form the colored molten polymer composition. The colored molten polymer composition is then extruded through the spinneret to form the colored fibers.

According to yet another preferred embodiment of the invention, a method for infusing liquid dyestuff into synthetic yarns at the point of fiber production is disclosed including the step of providing a molten polymer, at least one non-molten liquid dye, and a spin pack assembly including a first mix plate positioned upstream from a second mix plate, the first and second mix plates including respective complementary lower and upper surfaces. The lower and upper surfaces define a plurality of complementary first and second passageways, respectively, positioned in juxtaposing relation to and fluidly communicating with one another for receiving and mixing the molten polymer and the non-molten liquid dye therein to form a colored molten polymer composition. The spin pack assembly also includes a spinneret positioned downstream from and in fluid communication with the second mix plate for receiving and extruding the molten polymer composition therethrough to form a plurality of colored fibers adapted for being formed into the synthetic yarns. The method further includes the steps of metering the liquid dye and the molten polymer into a respective one of the first passageways and mixing the liquid dye and the molten polymer together within the first and second passageways to form the colored molten polymer composition. The colored molten polymer composition is then extruded through the spinneret to form the colored fibers.

According to yet another preferred embodiment of the invention, a method for infusing liquid dyestuff into synthetic yarns is disclosed, wherein the step of providing at least one non-molten liquid dye includes providing a non-molten liquid dye which is soluble in the molten polymer.

According to yet another preferred embodiment of the invention, a method for infusing liquid dyestuff into synthetic yarns is disclosed, wherein the step of providing at least one non-molten liquid dye includes providing a non-molten liquid dye which is insoluble in water.

According to yet another preferred embodiment of the invention, a method for infusing liquid dyestuff into synthetic yarns is disclosed, wherein the step of providing at least one non-molten liquid dye includes providing a non-molten liquid dye having a boiling point greater than the melting point of the molten polymer.

According to yet another preferred embodiment of the invention, a method for infusing liquid dyestuff into synthetic yarns is disclosed, wherein the step of providing a molten polymer includes providing a molten polymer selected from a group consisting of polyester, polypropylene, nylon-6.

According to yet another preferred embodiment of the invention, a method for infusing liquid dyestuff into synthetic yarns is disclosed, wherein the step of providing a non-molten liquid dye includes providing a non-molten liquid dye having at least one pigment which includes at least one primary color proportioned to produce a preselected color.

According to yet another preferred embodiment of the invention, a liquid color feed system for infusing liquid dye into synthetic yarns at the point of fiber production is disclosed. The feed system includes at least one non-molten liquid dye and a molten polymer received and stored within a respective one of a plurality of holding vessels, and a plurality of pressurized feed pumps. Each of the pumps is fluidly connected to a respective one of the holding vessels for pumping preselected amounts of the liquid dye and the molten polymer from the holding vessels. The feed system also includes a spin pack assembly fluidly connected to the feed pumps and including a screen for filtering the molten polymer therethrough, first and second mix plates positioned downstream from the screen and adapted for receiving and mixing the molten polymer and the non-molten liquid dye therebetweento form a colored molten polymer composition, and a spinneret adapted for receiving and extruding the colored molten polymer composition therethrough to form a plurality of colored fibers adapted for being formed into the synthetic yarns.

According to yet another preferred embodiment of the invention, the liquid color feed system further includes a centralized dye dispensing system removably connected to each of the vessels for selectively dispensing predetermined amounts of a plurality of non-molten liquid dyes into the vessels.

According to yet another preferred embodiment of the invention, the non-molten liquid dye is soluble in the molten polymer According to yet another preferred embodiment of the invention, the non-molten liquid dye is insoluble in water.

According to yet another preferred embodiment of the invention, the non-molten liquid dye has a boiling point greater than the melting point of the molten polymer.

According to yet another preferred embodiment of the invention, the molten polymer is selected from a group consisting of polyester, polyethylene terephthalate, nylon-6, and nylon-66.

According to yet another preferred embodiment of the invention, the liquid dye includes at least one pigment having at least one primary color proportioned to produce a preselected color.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
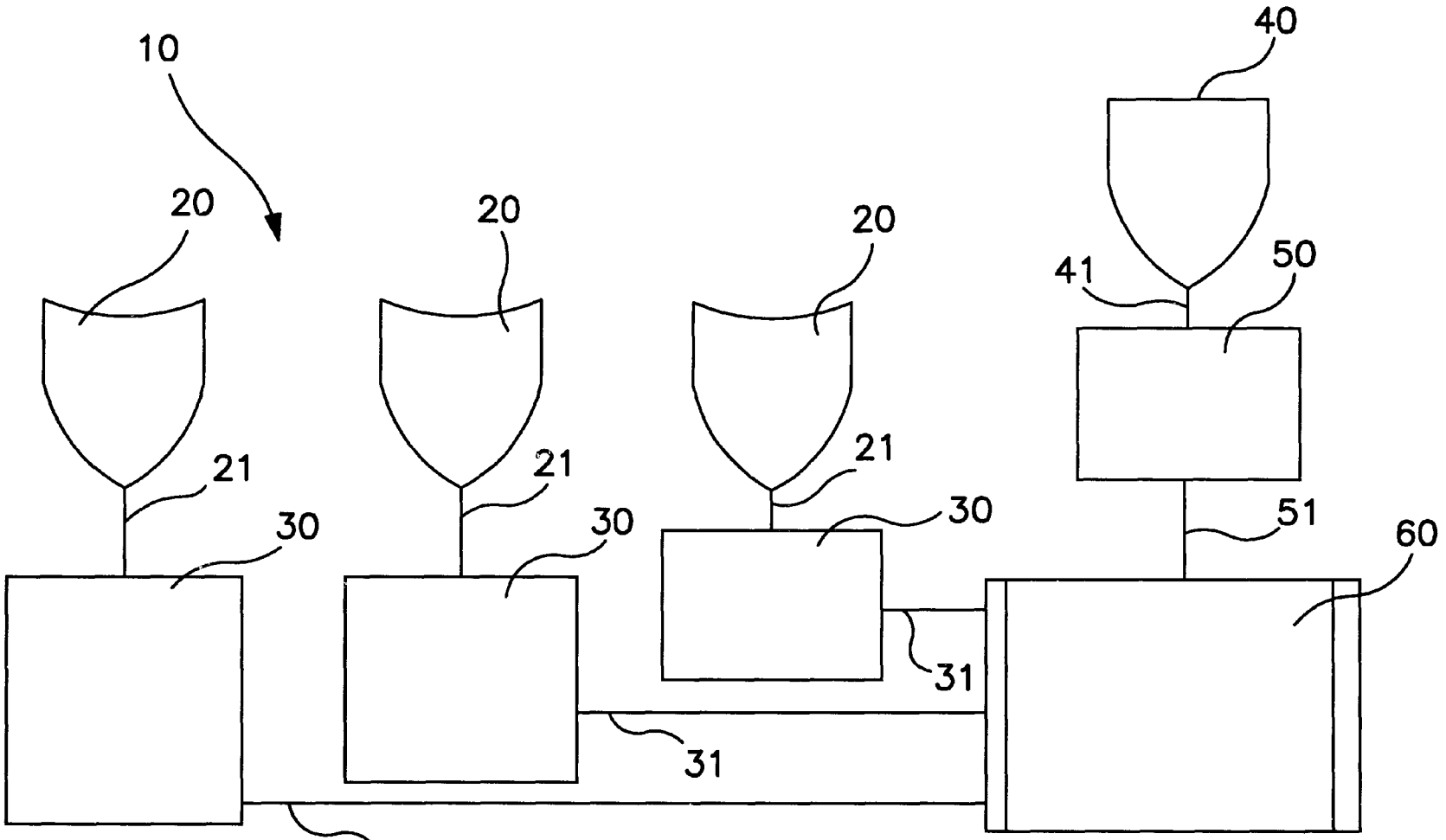
FIG. 1 is a simplified flow diagram of a liquid color feed apparatus and process according to an embodiment of the present invention.

Referring now specifically to the drawings, a liquid color feed system for infusing liquid dyestuff into synthetic yarns according to the present invention is illustrated in FIG. 1 and shown generally at reference numeral 10. Liquid dyes are maintained in a plurality of identical holding vessels 20 and are fed by gravity though a respective one of identical supply lines 21 to a respective one of a plurality of identical constant pressure metering pump systems 30. A molten polymer (not shown) from which synthetic fiber filaments are to be ultimately formed is likewise maintained in a holding vessel 40, and is fed by gravity through a supply line 41 into a constant pressure metering pump 50. The pumps 30 and 50 feed the liquid dyes and the molten polymer, respectively, under pressure to a multi-plate spin pack assembly 60 such as is disclosed in the '476 Patent. Each pump 30 utilizes constant pressure to achieve accurate feeding of the liquid dye at a predetermined flow rate that correlates with the feed rate of the molten polymer through the spin pack assembly 60.

Figure 2:
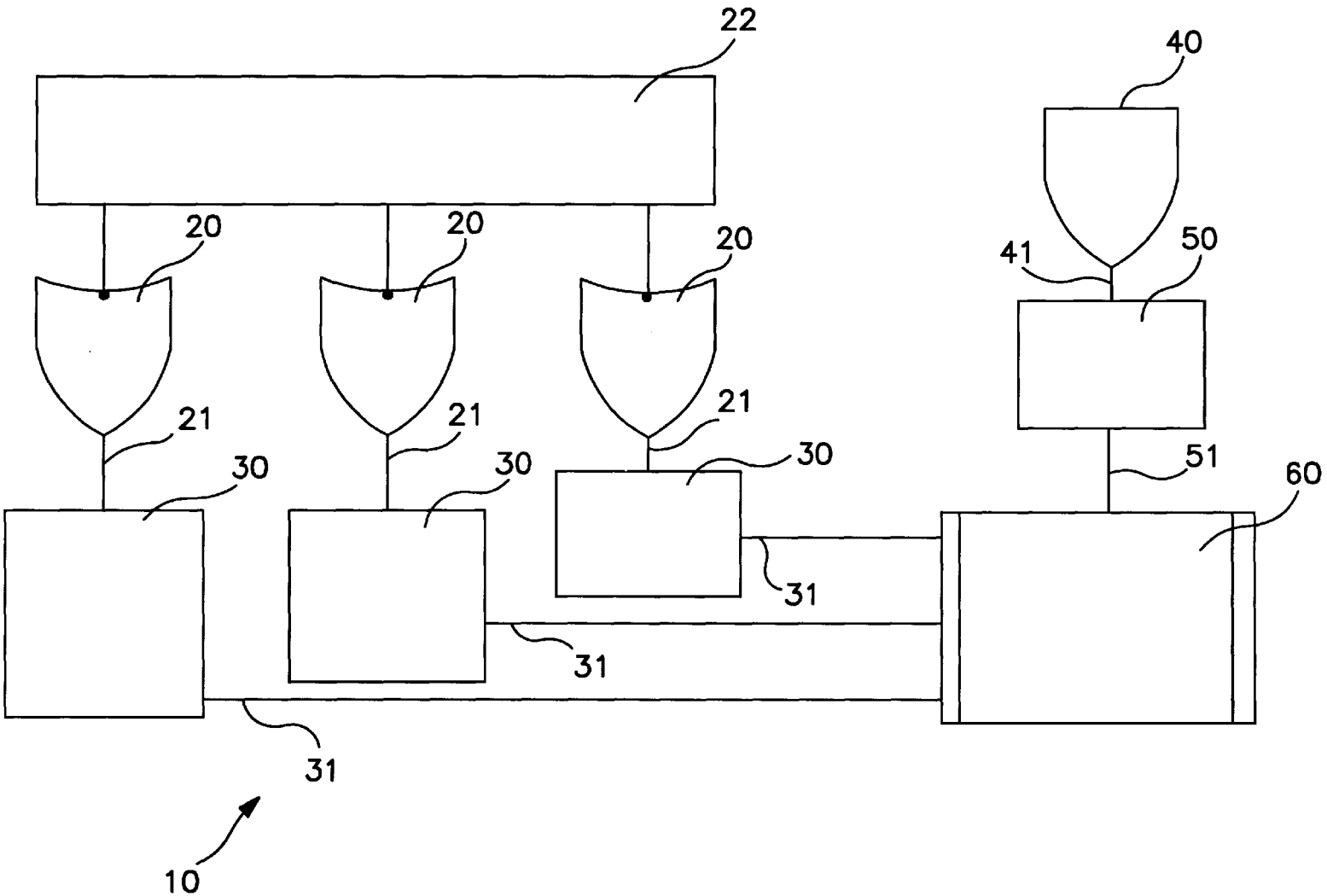
FIG. 2 is a simplified flow diagram of a liquid color feed apparatus and process according to another embodiment of the present invention.

Although any metering pump capable of maintaining constant pressure may be used, as discussed more fully below, each pump 30 is preferably a gear-type pump that moves the liquid dye through one of a plurality of respective supply lines 31 into the spin pack assembly 60. The pump 50 is likewise preferably a gear-type pump capable of forcing the molten polymer through an attached supply line 51 into the spin pack assembly 60. While the vessels 20 and 40 may be formed from any suitable material, each vessel 20 or 40 is preferably formed from stainless steel or some other material which is corrosion-resistant and easy to clean. In addition, each vessel 20 or 40 is preferably capable of being pressurized and quickly disconnected from the feed system 10 to permit the respective liquid dye or molten polymer contained therein to be exchanged or otherwise removed. As shown in FIG. 2, the vessels 20 can be configured to be fed from a color dispensing system 22, to increase the number of different colors that are introduced into the liquid dyes and subsequently mixed into the molten polymer within the spin pack assembly 60.

The vessels 20 and pump systems 30 are preferably placed at minimum possible distances from the spin pack assembly 60. In addition, the liquid dyes dispensed from the pumps 30 are preferably fed through the smallest possible lines in order to achieve quick color change compatibility while maintaining adequate dye flow therethrough at acceptable pressures. While any number of liquid dye colors may be used depending on the color desired in the final synthetic yarn product, the feed system 10 preferably simultaneously feeds and mixes up to four colors into a molten polymer.

Figure 3:
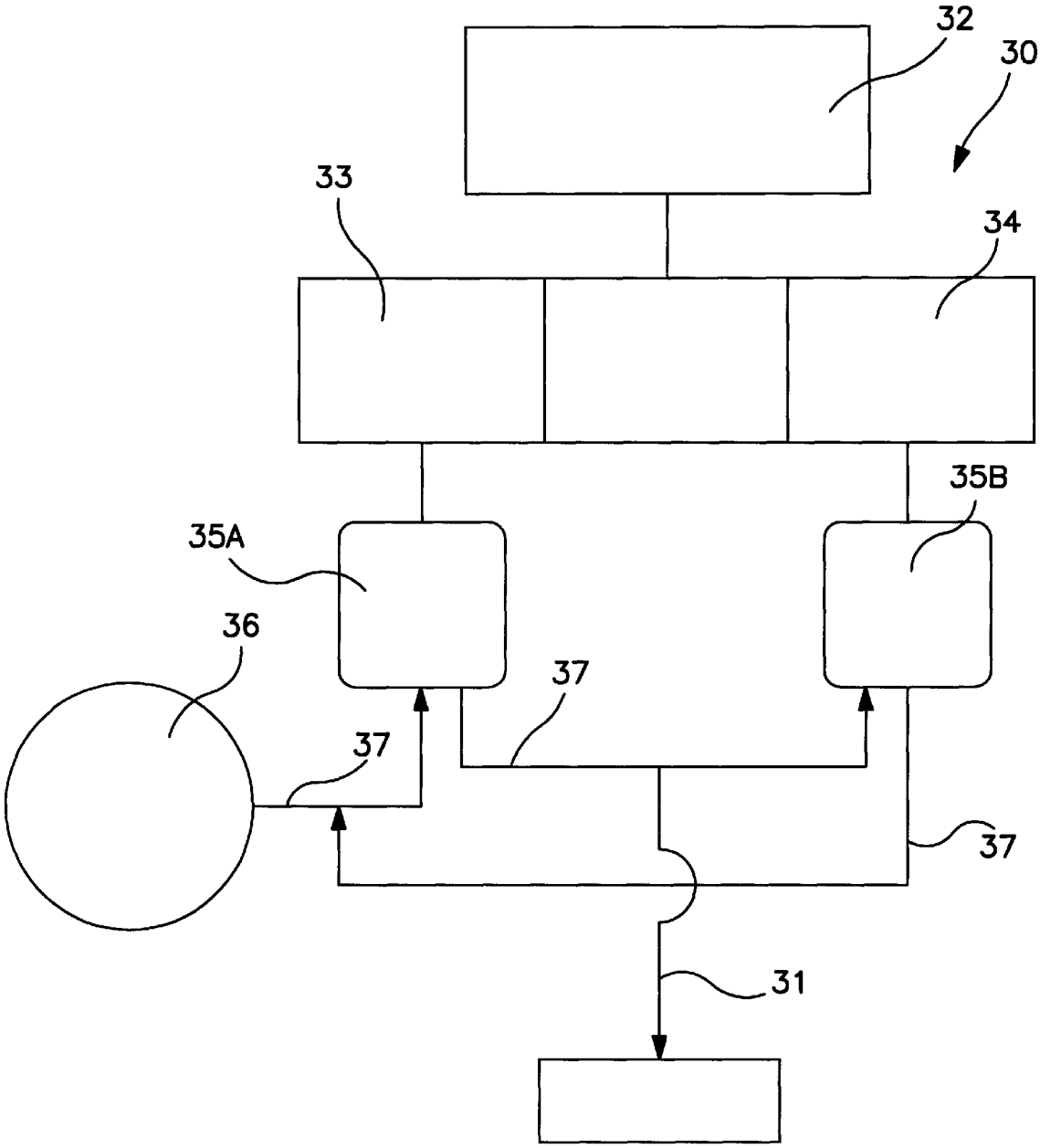
FIG. 3 is a simplified schematic of the pump system used in the present invention.

Referring now to FIG. 3, a diagram representing a single constant pressure metering pump system 30 is shown. The pump system 30 includes a motor 32 which drives two gears 33 and 34 at 10 rpm and 9.9 rpm, respectively. Gears 33 and 34 are connected to and drive a respective one of two identical metering pumps 35A and 35B. Pumps 35A and 35B operate at variable speeds corresponding to the rate at which respective gears 33 and 34 operate to move the liquid dye contained within the corresponding vessel 20 (not shown) through the pump system 30, and into the spin pack assembly 60. Each metering pump 35A and 35B is preferably an eight stream pump. A 2 m-lbs. pressure tank 36 is fluidly interconnected with pumps 35A and 35B by multiple supply lines 37 to ensure that the liquid dye moving therethrough is supplied at a constant pressure to the spin pack assembly 60.

Figure 4:
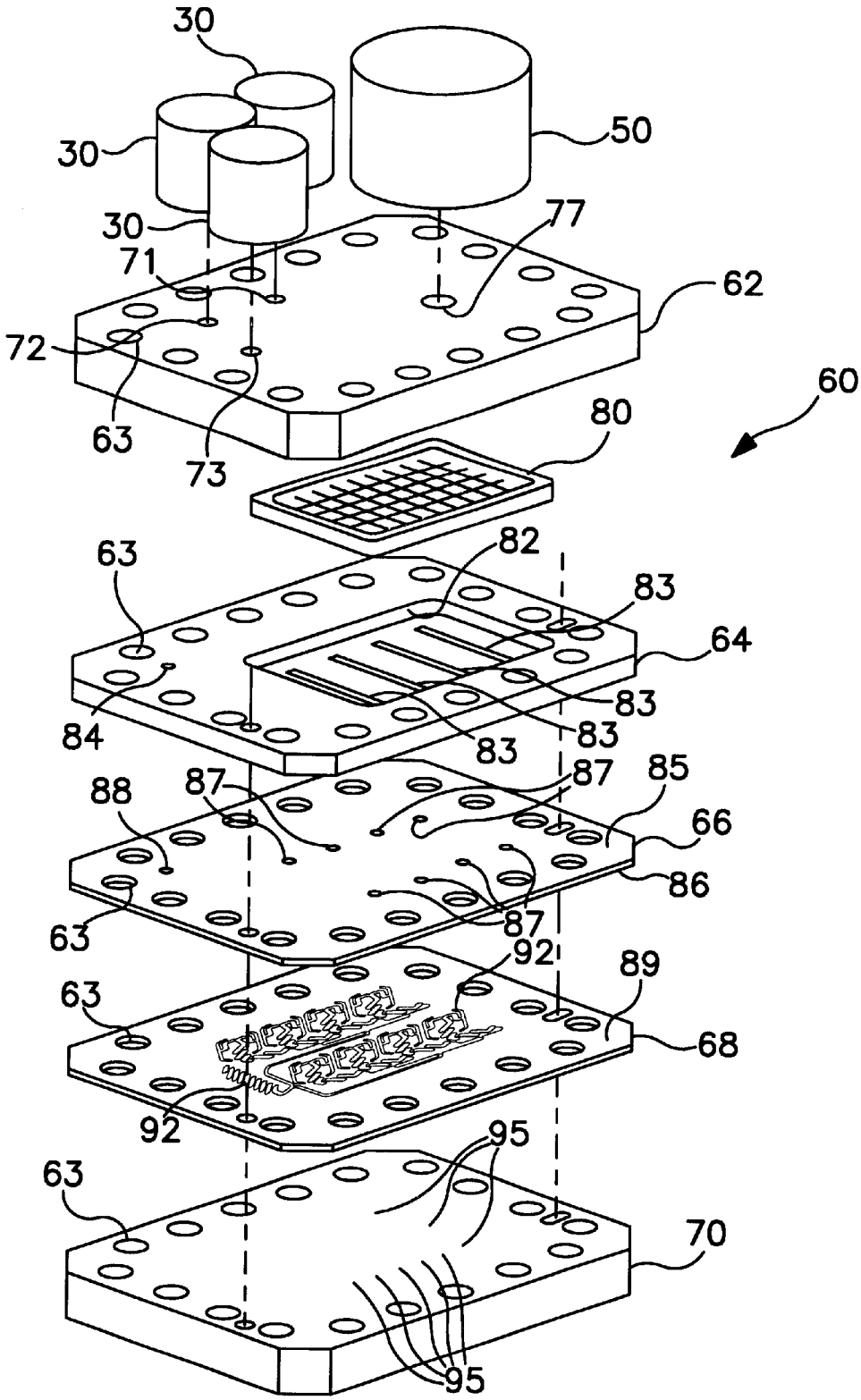
FIG. 4 is a copy of FIG. 2 of the '476 Patent, showing an exploded perspective view of the multi-plate spin pack assembly used in the present invention.
Figure 5:
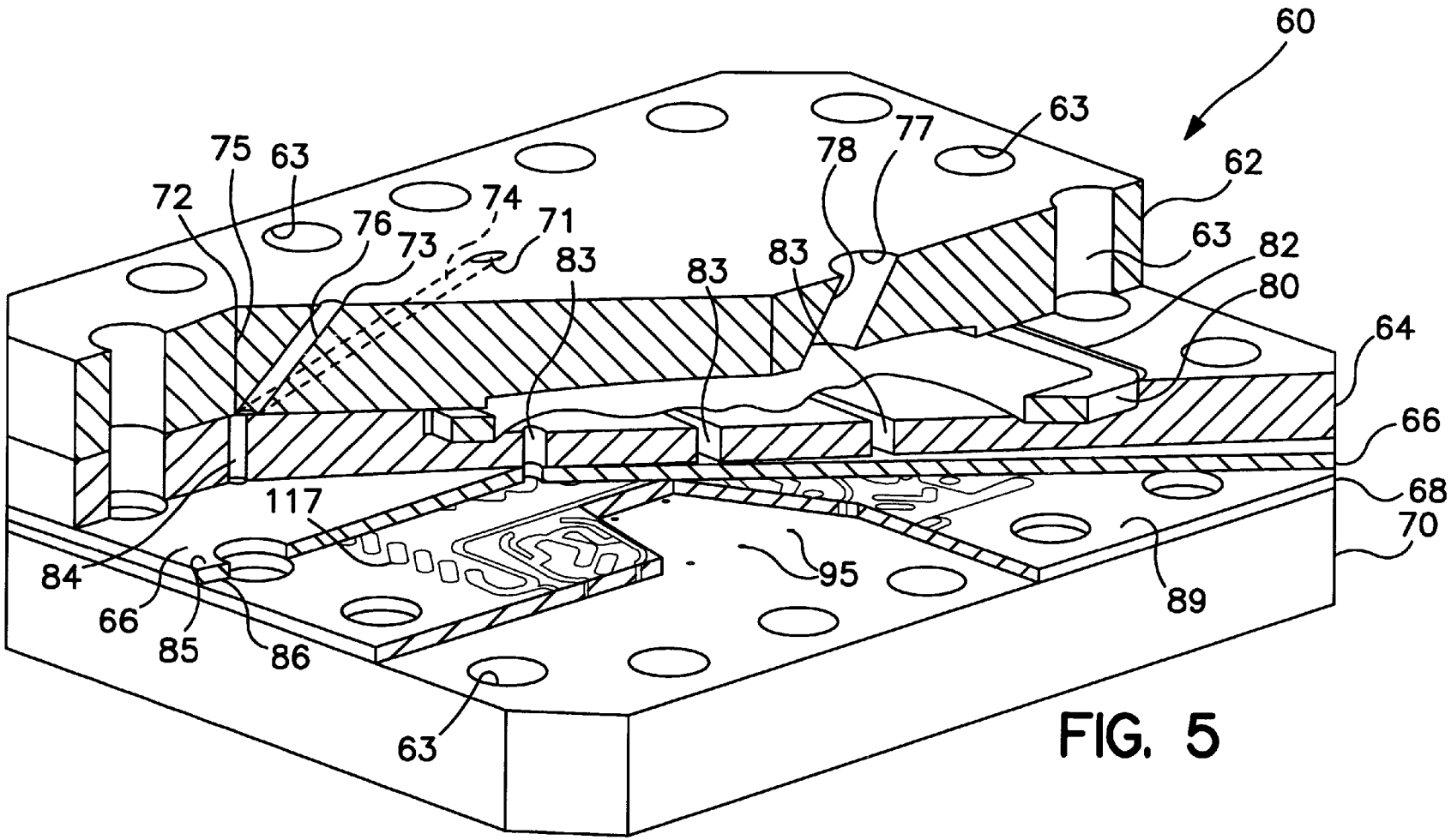
FIG. 5 is a copy of FIG. 1 of the '476 Patent, showing a cutaway perspective view of the multiplate spin pack assembly.

Referring now to FIGS. 4 and 5, detailed views of the spin pack assembly 60 are shown. The spin pack assembly 60 is manufactured by Hills, Inc., and is disclosed and discussed in detail in the aforementioned '476 Patent. As used in the present invention, the spin pack assembly 60 includes the following, assembled in order in an upstream to downstream direction: a top plate 62, a screen support plate 64, an upstream mix plate 66, a downstream mix plate 68 and a spinneret 70. Plates 62, 64, 66, 68 and spinneret 70 each define a plurality of identical bolt holes 63 through which bolts 63A (not shown) extend for securing the plates 62, 64, 66, 68, and spinneret 70 together. As is shown in FIG. 4, plate 62 defines three dye inlet ports 71, 72 and 73 which are in fluid communication with respective dye passageways 74, 75 and 76 (passageway 74 is shown drawn in phantom in FIG. 5). As is shown in FIG. 5, plate 62 also defines a polymer inlet port 77 and polmer passageway 78. Polymer passageway 78 extends through plate 62 and fluidly communicates with inlet port 77 for permitting molten polymer to travel therethrough and into a filter screen 80, which is removably positioned within a complementary filter screen bed 82 defined by screen support plate 64. Four identical through slots 83 (only three slots 83 are shown in FIG. 5) are defined by and extend through screen bed 82 for permitting the molten polymer to pass therethrough in a downstream direction to mix plate 66. Plate 62 likewise defines a single dye passageway 84, which is fluidly connected to respective dye passageways 74, 75 and 76. Liquid dyes travel through passageways 74, 75 and 76 and then merge into a single dye flow which travels downstream through dye passageway 84 to mix plate 66.

The non-molten liquid dyes and molten polymer travel through plates 62 and 64 completely segregated from one another. However, after traveling through the first mix plate 66, the liquid dyes and the polymer are mixed together. First mix plate 66 includes upper and lower faces 85 and 86, respectively. Eight identical polymer supply holes 87 are defined by first mix plate 66. Each hole 87 extends from upper face 85 through plate 66 to lower face 86. The holes 87 are arranged in pairs, each of which aligns and is in fluid communication with a respective one of the slots 83. A dye mix passageway 88 is likewise defined by and extends through mix plate 66 from the upper face 85 to the lower face 86. Dye mix passageway 88 is aligned and communicates with dye passageway 84 for conveying the liquid dye through first mix plate 66. After passing through dye mix passageway 88 and the holes 87, the non-molten liquid dye and molten polymer, respectively, are mixed together between the lower face 86 of first mix plate 66 and an upper face 89 of the second mix plate 68.

Figure 7:
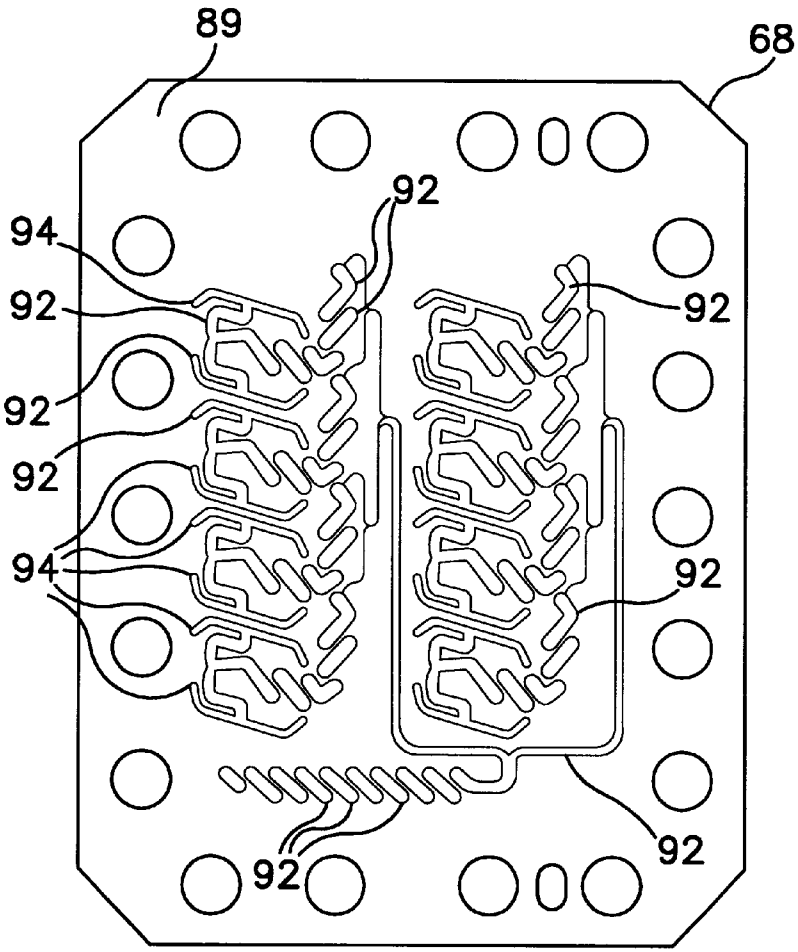
FIG. 7 is a copy of FIG. 10 of the '476 Patent, showing the complementary upper surface of another mixing plate in the spin pack assembly.
Figure 6:
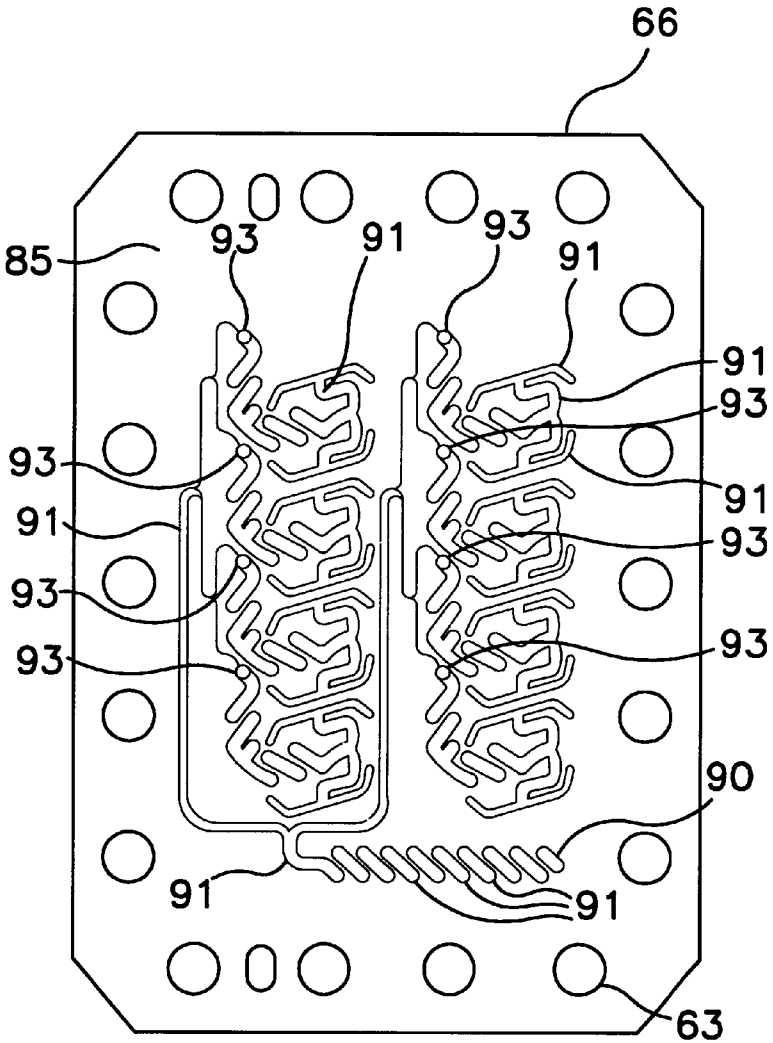
FIG. 6 is a copy of FIG. 9 of the '476 Patent, showing the lower surface of one of the mixing plates in the spin pack assembly.

Referring now to FIGS. 6 and 7, the manner in which the liquid dye and the molten polymer are mixed together is shown. The lower face 85 of first mix plate 66 is shown in FIG. 6, and FIG. 7 shows the upper face 89 of second mix plate 68. As is shown in FIG. 6, liquid dye traveling through first mix plate 66 exits therefrom through a dye outlet port 90, which is integrally formed and fluidly communicates with a set of first mixer channels 91 that are formed in lower face 85. As is shown in FIG. 7, first mixer channels 91 mate with a set of complementary second mixer channels 91 formed in upper face 89. First and second mixer channels 91 and 92 are in partial registry with one another. Molten polymer traveling through holes 87 exits through a respective one of eight corresponding polymer outlet ports 93 which are integrally formed and in fluid communication with first mixer channels 91. Upon entering the partially-registered first and second mixer channels 91 and 92, the liquid dye and molten polymer are blended together by successive alternating boundary layer interactions to form a color blended polymer that flows downstream through outlet passages 94, which are defined by and extend through second mixer plate 68. Referring again to FIGS. 4 and 5, the color blended polymer then flows into spinning orifices 95 defined in and extending through spinneret 70 and is extruded into a plurality of selectively colored fibers.

The process of mixing liquid dyes with the molten polymer in the spin pack assembly 60 is novel in that each dye is in a non-molten, liquid state when it is mixed with the molten polymer. The liquid dyes do not need to be pre-mixed with a melted polymeric carrier prior to being combined with the molten polymer base. Use of non-molten liquid dyes in spin pack assemblies such as described above and in the '476 Patent has not yet been achieved. The non-molten liquid dyes used in the present invention are generally characterized as having small particle size and high heat stability. Such dyes are also insoluble in water, soluble in polymeric material, and may be introduced to and mixed with such polymeric materials while the dyes are in a non-molten, liquid state. The dyes also exhibit good ultraviolet and weather resistance. In addition, the preferred liquid dyes are storage stable and are not subject to shearing under high pressure in restricted areas. Liquid dyes suitable for use in the present invention may also include, but are no limited to having, additives to enhance lightfastness, water repellency, water absorbency, antimicrobial characteristics, and soil release qualities. Molten polymers preferred for use in the present invention include but are not limited to polyester, polypropylene, and nylon 6.

One specific liquid dye preferred for use in the present invention with polyester, nylon 6 and polypropylene is a dye produced by Ciba Specialty Chemicals and sold under the tradename FILESTER YELLOW RNB. Also known by the generic name "Pigment Yellow 147," this yellow liquid dye includes anthraquinone, and has excellent heat stability and resists sublimation during melt-spinning processes. Other liquid dyes preferred for use in the present invention with nylon-6 and polypropylene include but are not limited to the following dyes produced by the Ferro Corporation:

| | | |
|---|---|---|
| (a) | Product Number: | 35-33-1 (Experimental) |
| | Description: | Rubine Dispersion |
| | Generic Name: | Pigment Red 254 |
| | Physical Properties: | Values: |
| | Weight per Gallon | 8.00 |
| | Viscosity | 23,000 cps |
| | Shelf Life | 1 Year |

-continued

| | |
|---|---|
| Product Composition: | |
| % Pigment (RED DPP-TR sold by Ciba Specialty Chemicals) | 11.50% |
| % Vehicle: | 88.50% |
| Total Solids: | 100.00% |
| Vehicle Type: | Ferro Corporation Proprietary PET Vehicle |
| (b) Product Number: | 35-34-1 |
| Description: | Yellow Dispersion |
| Generic Name: | Pigment Yellow 95 |
| Physical Properties: | Values: |
| Weight per Gallon | 8.30 |
| Viscosity | 25,000 cps |
| Shelf Life | 1 Year |
| Product Composition: | |
| % Pigment (CIBA YELLOW GR sold by Ciba Specialty Chemicals) | 20.00% |
| % Vehicle: | 80.00% |
| Total Solids: | 100.00% |
| Vehicle Type: | Ferro Corporation Proprietary PET Vehicle |
| (c) Product No: | 35-35-1 |
| Description: | Orange Dispersion |
| Generic Name: | Pigment Orange 61 |
| Physical Properties: | Values: |
| Weight per Gallon: | 8.67 |
| Viscosity: | 22,000 cps |
| Shelf Life: | 1 Year |
| Product Composition: | |
| % Pigment: (CIBA ORANGE 2G sold by Ciba Specialty Chemicals) | 25.00% |
| % Vehicle: | 75.50% |
| Total Solids: | 100.00% |
| Vehicle Type: | Ferro Corporation Proprietary PET Vehicle |
| (d) Product No: | 35-36-1 |
| Description: | Blue Dispersion |
| Generic Name: | Pigment Blue 15:4 |
| Physical Properties: | Values: |
| Weight per Gallon | 8.50 |
| Viscosity | 18,000 cps |
| Shelf Life | 1 Year |
| Product Composition: | |
| % Pigment (Product No. 249-3450 sold by Sun Chemical) | 23.00% |
| % Vehicle: | 77.00% |
| Total Solids: | 100.00% |
| Vehicle Type: | Ferro Corporation Proprietary PET Vehicle |

Testing of the above-referenced liquid dyes was carried out in a laboratory process line. Polymer resin chips were first manually loaded into dryers and dried overnight using either a 100 pound capacity column-type dryer manufactured by Conair, or a 200 pound capacity dryer manufactured by Novatec. The chips were then run through a respective one of two single-screw extruders at a maximum rate of 30 pounds per hour per extruder to produce homogenized molten polymer, which was run through four zones with the extruder, with no cooling. The extruders were 1¼" diameter, 5 HP DC units manufactured by Hills, Inc. One of the extruders had a plugged vent. Each extruder was equipped with a general purpose screw having a Maddox (UC) mixer at its end. One DSB barrier flight screw was available. The current of each extruder was monitored, and the speed of each screw was controlled to ensure that a set pressure was maintained at the entrance to the meter pump.

The molten polymer was next pumped through a single pack spin head and polymer distribution block. The spin head was bottom loaded, and electrically heated up to 350 degrees Celcius. Pack pressure was monitored on two molten polymer streams traveling therethrough, and the spin head housing temperature was maintained at a controlled set point while the steel polymer distribution block located therein was simultaneously monitored. Two 1×6 cc/rev (2.92 were available) meter pumps were located on the polymer distribution block for pumping a respective one of the two molten polymer melt streams.

The molten polymer melt streams were then pumped into a spin pack and extruded through a spinneret. Two types of spin packs were used. The first spin pack was a 7"×5½" bicomponent (BRD). The following spinnerets were found suitable for use in the BRD spin pack: bifilament or homofilament, 126 hole delta, 126 round, 135 trilobal, 144 trilobal, 144 round, 288 round, 288 trilobal, 756 trilobal, 3216 round, and 144 delta. The second spin pack was a 5" square (PRD). The following spinnerets were found suitable for use with the PRD: Homofilament, 2×72 hole Delta (3 sizes), 41 Delta, and 68 Round (3 sizes). Both the BRD and PRD spin packs used flat, rim-bound screen filtration, with screens formed of 150×150 square weave mesh; however, finer meshes could have been used by adding additional layers of screen material. Polymer distribution plates were used within the spin packs to produce various fibers, including but not limited to, side-by-side, sheath/core, A-B-A, stripped, pie, islands-in-a-sea, and other cross sections.

After being extruded through the spinneret, the molten polymer fibers were passed downwardly through a heated quench delay tube, which prevented that portion of the fibers immediately adjacent to the spinneret from being quenched, or cooled, too quickly. Two different tubes having 8" and 24" lengths, respectively, were found suitable for use with the present invention. Both tubes were able to operate up to 300 degrees Celcius. The fibers were then subjected to one of four quenching processes in which cooling air was introduced into the path of the fibers. All of the quenching systems used were of the crossflow air type. The first quenching system had an adjustable slot suitable for short gap work. This quenching system was able to deliver air at very high velocities, such as over 2,000 fpm. The second quenching system was 4" long and capable of delivering air at velocities ranging from 500 to 1,000 fpm. The third system provided a two-sided quench to both the front and back of the fibers. This system was 10" long and capable of delivering air at velocities up to approximately 500 fpm on each side. The fourth quenching system was 5 feet long and capable of delivering air at a maximum velocity of 200 fpm. Air speeds in all four of the quenching systems were adjustable using variable speed blowers. Air within each of the quenching systems was maintained at ambient temperatures, or airflow was generated from an air conditioner at about 50 degrees Fahrenheit, which was not adjustable. Some simple water quench baths were available for limited testing of monofilaments, ribbon, yarns, and very heavy DPF multifilaments.

A spin finish was applied to the quenched fibers using either a Kiss roll or a metered finish roll to promote bundle cohesion. The yarn was then fed around unheated, twin canted denier rolls at speeds ranging from approximately 20 MPM to over 2,000 MPM. The finished fibers were then processed using one of the following options:

a. The yarn was undrawn from the denier rolls on to a Leesona winder at speeds ranging from 20 MPM up to approximately 2,100 MPM;

b. Partially-oriented yam (POY) was processed by winding up one or two packages, one at a time, on a Barmag winder at speeds up to 6,000 MPM;

c. Drawstand-rolls were heated up to 180 degrees Celcius. Four independent rolls were wound via a Leesona 968 twin or single cop winder at speeds of up to 2,200 MPM. The maximum speed used was just over 2200 MPM;

d. Yarn was processed unto a drawtexturing machine direct from the spinning machine. Such yarn was processed from 600–15,000 denier via a cooling drum to 1200 MPM. Process limitations existed on these machines at higher speeds and deniers, and heavier deniers had to be fed from a creel from multiple bobbins to the drawtexturing machine; or e. Yarn was processed into spunbonded fabrics of 0.2–5.0 $oz/yr^2$.

An apparatus and process for infusing liquid dyestuff into synthetic yarn and the point of fiber production is described above. Various details of the invention may be changed without departing from its scope. Furthermore, the foregoing description of the preferred embodiment of the invention and the best mode for practicing the invention are provided for the purpose of illustration only and not for the purpose of limitation.

We claim:

1. A method of infusing liquid dyestuff into synthetic yarns at the point of fiber production, comprising the steps of:

(a) providing a molten polymer, at least one non-molten liquid dye, and a spin pack assembly adapted for receiving and mixing said molten polymer and said non-molten liquid dye therein to form a colored molten polymer composition, said spin pack assembly including a screen for filtering the molten polymer therethrough, and a spinneret adapted for receiving and extruding said molten polymer composition therethrough to form a plurality of colored fibers adapted for being formed into said synthetic yarns;

(b) metering said liquid dye and said molten polymer into the spin pack assembly upstream from said spinneret;

(c) mixing the liquid dye and the molten polymer together between said screen and the spinneret within the spin pack assembly, thereby forming said colored molten polymer composition; and (d) extruding the polymer composition through the spinneret, thereby forming said colored fibers.

2. A method of infusing liquid dyestuff into synthetic yarns at the point of fiber production, comprising the steps of:

(a) providing a molten polymer, a plurality of non-molten liquid dyes, and a spin pack assembly adapted for receiving and mixing said molten polymer and said non-molten liquid dyes therein to form a colored molten polymer composition, said spin pack assembly including a screen for filtering the molten polymer therethrough, and spinneret adapted for receiving and extruding said colored molten polymer composition therethrough to form a plurality of colored fibers adapted for being formed into said synthetic yarns;

(b) metering said liquid dyes and said molten polymer into the spin pack assembly upstream from said spinneret;

(c) mixing the liquid dyes and the molten polymer together within the spin pack assembly between said screen and the spinneret, thereby forming said colored molten polymer composition; and (d) extruding the colored molten polymer composition through the spinneret, thereby forming said colored fibers.

3. A method for infusing liquid dyestuff into synthetic yarns at the point of fiber production, comprising the steps of:

(a) providing a molten polymer, at least one non-molten liquid dye, and a spin pack assembly including:

(i) a plurality of plates in fluid communication with one another and adapted for receiving and mixing said molten polymer and said non-molten liquid dye therein to form a colored molten polymer composition; and (ii) a spinneret positioned downstream from and in fluid communication with said plates for receiving and extruding said colored molten polymer composition into a plurality of colored fibers adapted for being formed into said synthetic yarns;

(b) metering the liquid dye and the molten polymer into said plates;

(c) mixing the liquid dye and the molten polymer together within the plates to form the colored molten polymer composition; and (d) extruding the colored molten polymer composition through said spinneret to form said colored fibers.

4. A method for infusing liquid dyestuff into synthetic yarns at the point of fiber production, comprising the steps of:

(a) providing a molten polymer, at least one non-molten liquid dye, and a spin pack assembly including:

(i) a first mix plate positioned upstream from a second mix plate, said first and second mix plates in fluid communication with one another and adapted for receiving and mixing said molten polymer and said non-molten liquid dye therebetween to form a colored molten polymer composition; and (ii) a spinneret positioned downstream from and in fluid communication with the second mix plate for receiving and extruding said colored molten polymer composition to form a plurality of colored fibers adapted for being formed into said synthetic yarns;

(b) metering the liquid dye and the molten polymer into the first mix plate;

(c) mixing the liquid dye and the molten polymer together within the first and second mix plates to form the colored molten polymer composition; and (d) extruding the polymer composition through said spinneret to form said colored fibers.

5. A method for infusing liquid dyestuff into synthetic yarns at the point of fiber production, comprising the steps of:

(a) providing a molten polymer, at least one non-molten liquid dye, and a spin pack assembly including:

(i) a first mix plate positioned upstream from a second mix plate, said first and second mix plates defining a plurality of intersecting passageways extending therebetween, each of said passageways adapted for receiving and mixing said colored molten polymer and said non-molten liquid dye therein to form a colored molten polymer composition; and (ii) a spinneret positioned downstream from and in fluid communication with the passageways for receiving and extruding said molten polymer composition to form a plurality of colored fibers adapted for being formed into said synthetic yarns;

(b) metering the liquid dye and the molten polymer into a respective one of the passageways;

(c) mixing the liquid dye and the molten polymer together within the passageways to form said colored molten polymer composition; and (d) extruding the colored molten polymer composition through said spinneret to form said colored fibers.

6. A method for infusing liquid dyestuff into synthetic yarns at the point of fiber production, comprising the steps of:

(a) providing a molten polymer, at least one non-molten liquid dye, and a spin pack assembly including:

(i) a first mix plate positioned upstream from a second mix plate, said first and second mix plates including complementary lower and upper surfaces defining a plurality of complementary first and second passageways, respectively, positioned in juxtaposing relation to and fluidly communicating with one another for receiving and mixing said molten polymer and said non-molten liquid dye therein to form a colored molten polymer composition; and (ii) a spinneret positioned downstream from and in fluid communication with the passageways for receiving and extruding said molten polymer composition therethrough to form a plurality of colored fibers adapted for being formed into said synthetic yarns;

(b) metering the liquid dye and the molten polymer into a respective one of said first passageways;

(c) mixing the liquid dye and the molten polymer together within the first and second passageways to form the colored molten polymer composition; and (d) extruding the polymer composition through said spinneret to form said colored fibers.

7. A method for infusing liquid dyestuff into synthetic yarns according to claim 1, 2, 3, 4, 5, or 6, wherein said non-molten liquid dye is soluble in the molten polymer.

8. A method for infusing liquid dyestuff into synthetic yarns according to claim 1, 2, 3, 4, 5, or 6, wherein said non-molten liquid dye is insoluble in water.

9. A method for infusing liquid dyestuff into synthetic yarns according to claim 1, 2, 3, 4, 5, or 6, wherein said non-molten liquid dye has a boiling point greater than the melting point of the molten polymer.

10. A method for infusing liquid dyestuff into synthetic yarns according to claim 1, 2, 3, 4, 5, or 6, wherein said molten polymer is selected from a group consisting of polyester, polypropylene, and nylon-6.

11. A method for infusing liquid dyestuff into synthetic yarns according to claim 1, 2, 3, 4, 5, or 6, wherein said non-molten liquid dye comprises at least one pigment including at least one primary color proportioned to produce a preselected color.

* * * * *